United States Patent [19]

Khawand

[11] 3,973,340

[45] Aug. 10, 1976

[54] METHOD AND APPARATUS FOR CREATING VISUAL DISPLAYS

[76] Inventor: Antoine B. Khawand, 400 Madison Ave., New York, N.Y. 10017

[22] Filed: June 10, 1974

[21] Appl. No.: 477,798

Related U.S. Application Data

[63] Continuation of Ser. No. 325,899, Jan. 22, 1973, abandoned, which is a continuation of Ser. No. 71,989, Sept. 14, 1970, abandoned.

[30] Foreign Application Priority Data

| | | |
|---|---|---|
| Sept. 23, 1969 | Lebanon | 2941/1 |
| Oct. 31, 1969 | Switzerland | 16163/69 |
| Sept. 14, 1971 | Germany | 2145889 |
| Sept. 14, 1971 | Japan | 46-71674 |

[52] U.S. Cl. ..... 40/106.21; 40/28 C; 40/106.22

[51] Int. Cl.[2] ..... G09F 13/24

[58] Field of Search ..... 40/106.21, 106.22, 28 C, 40/37; 137/340; 138/121; 73/61.1 R

[56] References Cited

UNITED STATES PATENTS

| | | | |
|---|---|---|---|
| 708,703 | 9/1902 | Floyd | 137/340 X |
| 1,979,336 | 11/1934 | Martin et al. | 40/106.21 |
| 2,571,470 | 10/1951 | Milligan | 73/61.1 R |
| 2,621,430 | 12/1952 | Neville | 40/106.21 X |
| 3,058,245 | 10/1962 | Pieters | 40/106.21 |
| 3,238,452 | 3/1966 | Schmitt et al. | 73/61.1 R UX |
| 3,578,777 | 5/1971 | De Gain | 138/121 |

FOREIGN PATENTS OR APPLICATIONS

| | | | |
|---|---|---|---|
| 11,967 | 3/1933 | Australia | 40/106.21 |
| 745,022 | 3/1933 | France | 40/106.22 |
| 23,849 | 10/1912 | United Kingdom | 40/106.22 |
| 382,743 | 11/1932 | United Kingdom | 40/106.22 |

*Primary Examiner*—John F. Pitrelli
*Attorney, Agent, or Firm*—Darby & Darby

[57] ABSTRACT

Method and apparatus for creating a visual display is provided in which one or more conduits are provided in which immiscible fluids are placed for creating a predetermined visual pattern.

14 Claims, 19 Drawing Figures

INVENTOR
ANTOINE B. KHAWAND
BY

Bierman & Bierman ATTORNEYS

FIG. 7
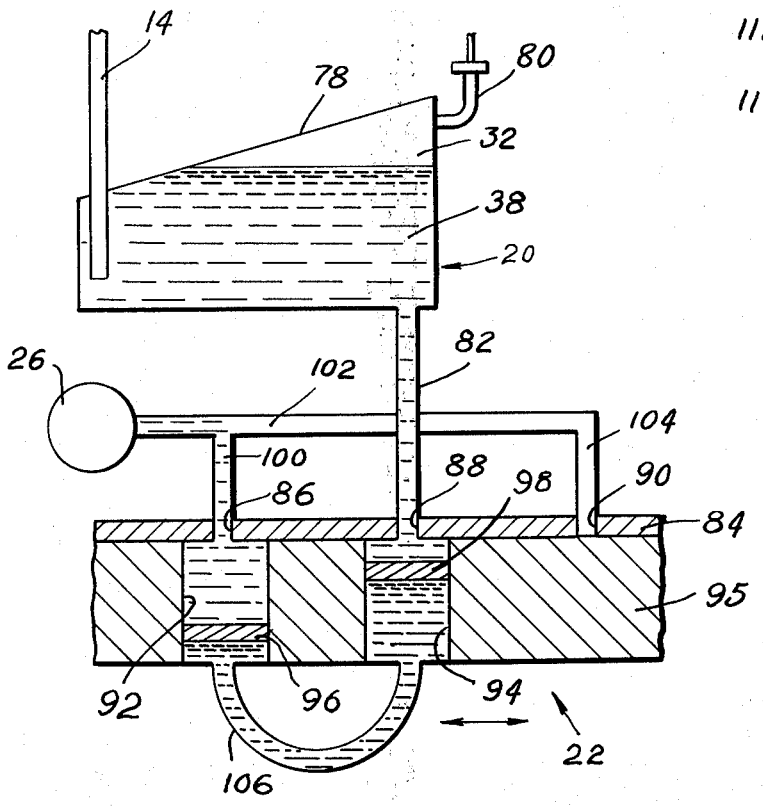
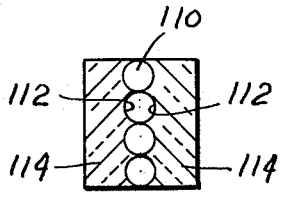
FIG. 9
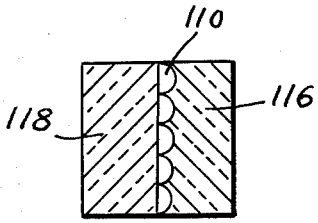
FIG. 10
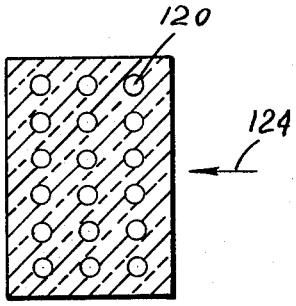
FIG. 11
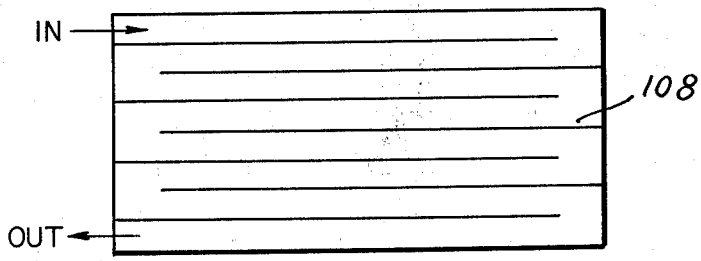
FIG. 8
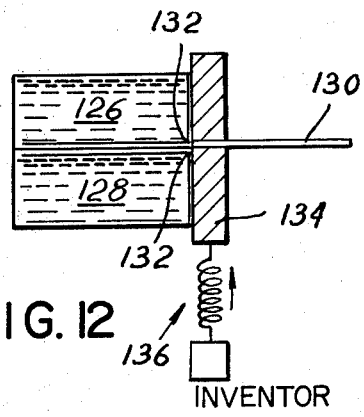
FIG. 12
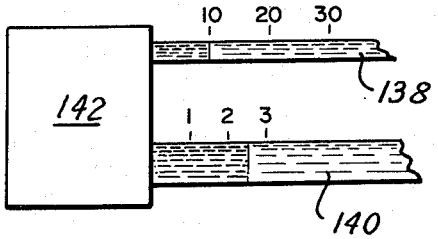
FIG. 13
INVENTOR
ANTOINE B. KHAWAND
BY
Bierman & Bierman ATTORNEYS FIG. 14
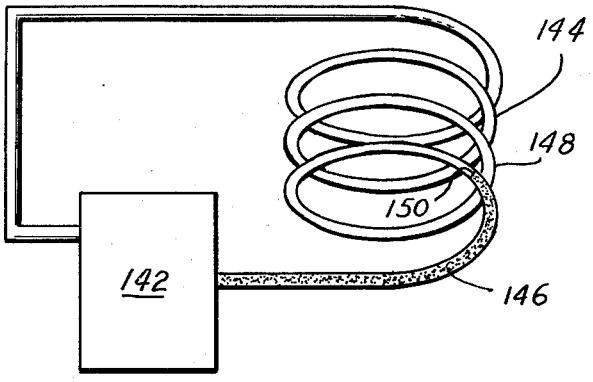
FIG. 15
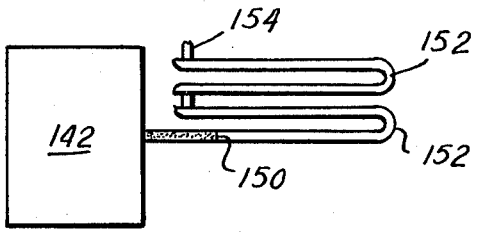
FIG. 16
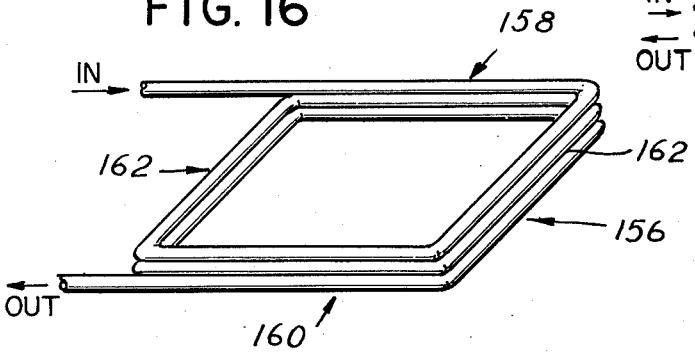
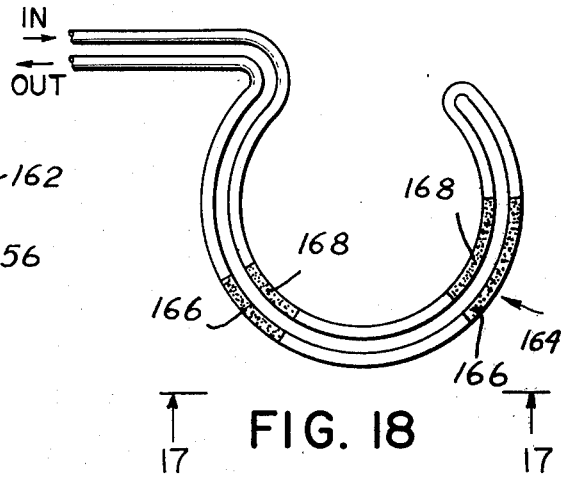
FIG. 18
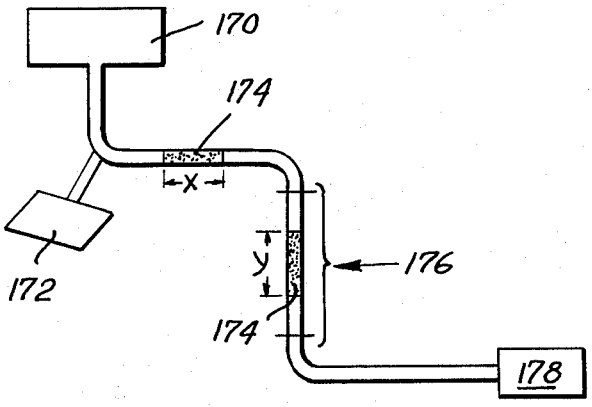
FIG. 19
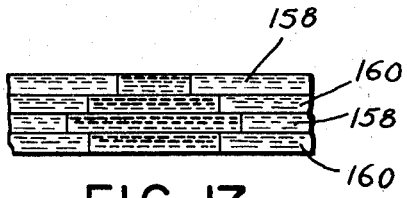
FIG. 17
INVENTOR
ANTOINE B. KHAWAND
BY
Bierman & Bierman ATTORNEYS

METHOD AND APPARATUS FOR CREATING VISUAL DISPLAYS

This application is a continuation of my prior copending application Serial No. 325,899, filed Jan. 22, 1973, now abandoned, which in turn was a continuation of my then copending application Serial No. 71,989, filed Sept. 14, 1970, now abandoned.

This invention relates to visual displays and more specifically, to visual displays utilizing a plurality of different fluids to create a desired visual pattern.

In accordance with the present invention, one or more translucent or transparent conduits or tubes are adapted to carry at least two different immiscible fluids therein for creating various visual patterns in the conduit. Preferably, the immiscible fluids have different reflective or refractive qualities so that, when viewed, the desired visual pattern is easily discernible. Any number of such tubes may be placed adjacent each other, each tube forming a part of the total visual display desired.

As used in this specification and claims, the term "immiscible" shall apply to liquids which are naturally immiscible with each other, similar liquids kept separated by naturally-occurring phenomena such as thermal layering; and gases which are non-dissolvable in the liquid used in connection with the gas.

In contrast with the use of a plurality of light bulbs which are generally used to form visual displays, especially for advertising purposes, the fluid-containing conduits of the present invention require fewer operative parts and the need for switching circuitry incident to the creation of a moving display when using light bulbs is not necessary when using the fluid-containing conduits of the present invention.

To create a desired visual display, a first fluid, such as water, is inserted in the conduit or tube, and a second fluid, such as a gas immiscible in the first fluid, or a liquid immiscible therewith, is injected into the tube such that its position in the first fluid corresponds to the position desired for the visual diisplay. Where it is desired to create a moving visual display, the fiirst fluid is moved through the tubes and the second fluid is injected at predetermined intervals into the moving fluid.

The conduits or tubes described herein need not be specially fashioned into a particular design which permanently sets the display pattern. It is not the shape of the tube which defines the visual pattern, but the relationships and positions of the fluids. As used in the specification and claims, the term "regular flow path" refers to conduits which do not create the pattern by the shape in which they are formed, but wherein the created pattern is at least partly independent of the shape of the conduit. The conduits used herein can be straight and parallel to each other and still create the desired effect. In addition, the term "defined by" is used to indicate the manner in which the display is created and to refer to the specific fact that the display is created by the relationships, positions, and movement of the fluids along the regular flow path rather than exclusively the shape of the conduit.

The fluids are used herein to create the display itself and not merely as a means for attracting attention to the already-formed display. Because the pattern can be changed by the relationship and location of the fluids, and not only through an alteration of the flow path, substantial versatility is achieved.

For best results, the conduit or its internal surface is made of a non-wettable substance such as polyethylene, or other synthetic plastic to help prevent capillary action from displacing the lighter fluid opposite to the direction of gravity when the tubes are installed for use in any but the horizontal position.

Referring now to the drawings, in which like numerals refer to like parts:

FIG. 7 is a detail view of a preferred embodiment of an apparatus for separating the two fluids after their function has been served.

FIG. 8 is a detailed view of a simple conduit useful in forming the visual displays of the instant invention;

FIGS. 9 and 10 are detail views in section of particular types of conduits;

FIG. 11 is a detail view in section of a multilayered conduit;

FIG. 12 is a schematic view of an apparatus for intermittently injecting different colored fluids into a single conduit.

FIG. 13 is a schematic detail view of a display apparatus useful for time measuring functions;

FIGS. 14 and 15 are schematic views of other apparatus useful for time measuring functions;

FIG. 16 is a perspective view of a conduit useful for providing multiple visual displays;

FIG. 17 is a front view of a visual pattern produced in the conduit of FIG. 16;

FIG. 18 is a top schematic view of another conduit useful for providing multiple visual displays; and FIG. 19 is a schematic view of an apparatus useful for correcting tolerance errors in a conduit.

Figure 1:
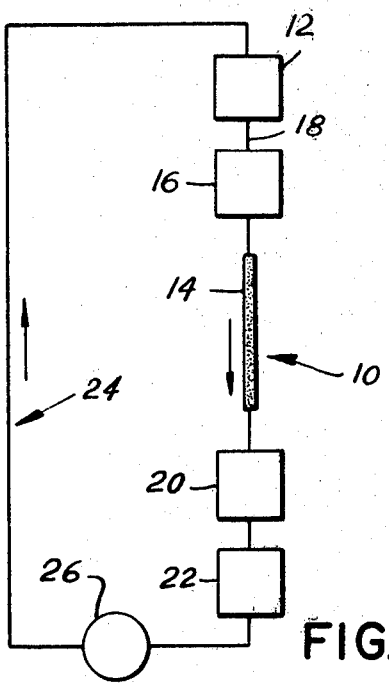
FIG. 1 is a schematic flow diagram of a preferred embodiment of the visual display system of the present invention.

Referring now to FIG. 1, the numeral 10 denotes a system for carrying out the present invention in which 12 is a fluid reservoir adapted to supply the first fluid to visual display conduits 14, and 16 is a fluid injector adapted to intermittently inject the second fluid into the first fluid as it flows in conduit 18 to the conduit 14. The system shown in FIG. 1 is one designed for the continuous movement of the visual display pattern through the conduits and the recirculation of at least the first fluid for reuse. To achieve this, a fluid separator 20 is provided for separating the fluids after they have served their purpose and a device for removing at least the first fluid from the fluid separator 20. is provided. The device 22 is adapted to maintain the first fluid in the recirculation loop indicated generally by the numeral 24. A conventional pump may be provided in the recirculation loop 24 for continuously recirculating the separated fluid to reservoir 12 for reuse.

In instances in which the two fluids used are liquids rather than a liquid and a gas which would be the most common form in which to use the instant invention, the device 22 may remove each separated liquid for recirculation and reuse in the system. Examples of liquids usable together are copper sulfate solution supersaturated with ammonia and ethylene dichloride. Obviously, a separate recirculation loop will have to be provided for each fluid.

Although the description of the preferred embodiment of the present invention will be in terms of the use of two fluids, it is to be understood that any number of fluids, whether liquid or gas, and any combination thereof, may be used to create the visual displays of the present invention.

Figure 2:
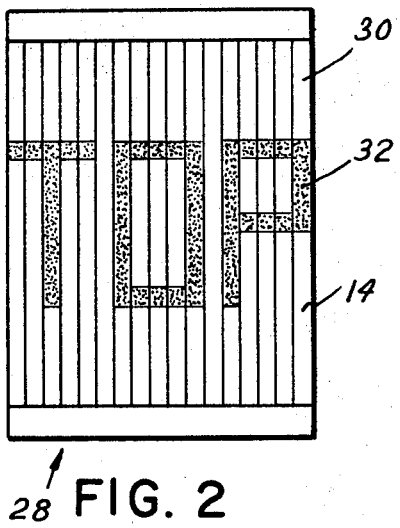
FIG. 2 is a front plan view of a plurality of tubes carrying a visual display therein.

Referring now to FIG. 2, a plurality of conduits 14 are shown mounted on a board 28 by conventional means. Each conduit is adapted to carry a liquid such as water therein, indicated by the numeral 30, and a gas such as air, generally indicated by the numeral 32. As can be readily appreciated, different quantities of the two fluids 30 and 32 are utilized in each tube to form the visual display of the word "TOP". Although the conduits 14 are shown mounted on a board, it is contemplated that they may be mounted on any type of holding device other than a board such as conventional clamps adapted to support the conduits only at their ends. In addition, the support does not have to be planar and it is contemplated that the support and conduits may be arranged in any manner as three-dimensional pattern.

Figure 3:
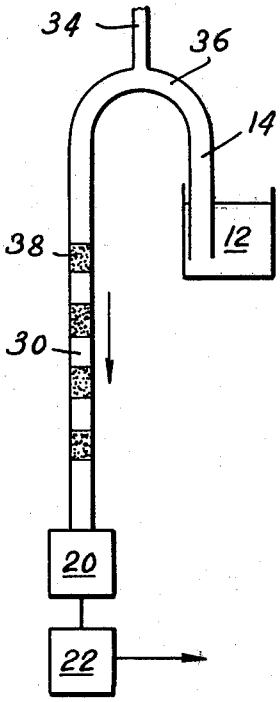
FIG. 3 is a detail plan view of one embodiment of a tube usable with the apparatus of FIGS. 1 and 2.

FIG. 3 depicts one embodiment of a conduit useful in the apparatuses of FIGS. 1 and 2 in which the fluid reservoir 12 is placed at a predetermined height above the point at which the conduit joins with fluid separator 20 to create a hydrostatic head for removing fluid from the fluid reservoir through the conduit 14. Conduit 14 has one end thereof placed in fluid reservoir 12 and an opening or port 34 is placed in the curve portion 36 of the conduit 14 through which the gas is injected at selected intervals to form the visual display. The control of the injection of gas through orifice 34 into conduit 14 may be achieved by conventional valve means well known in the art or by the devices hereinbelow described. As shown in FIG. 3, the gas 32 is injected in equal amounts at periodic intervals to form the display therein depicted. However, the spacing between injections of the same fluid need not be equal nor need the amounts of such fluid subsequently injected be equal to that previously injected. The only consideration governing the amount and spacing of the various fluids is the desired visual pattern.

Figure 4:
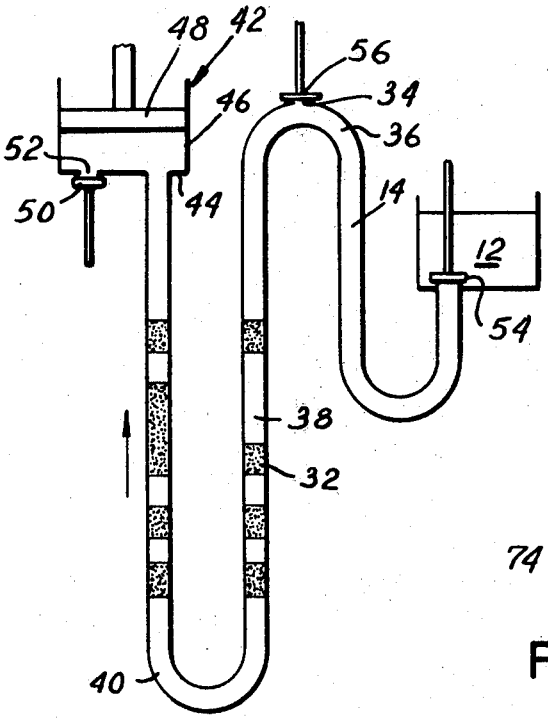
FIG. 4 is a schematic plan view of another embodiment of a conduit usable with apparatus of FIGS. 1 and 2.

Another embodiment of the conduit useful in the present invention is depicted in FIG. 4 in which the conduit 14 is provided with two re-entrant sections 38 and 40 which may be separated by board or other conventional shielding device (not shown) to create a visual display on both sides of the board. In the embodiment shown in FIG. 4, since the end of the conduit 14 is above the reservoir 12, positive means for moving the fluid through the tube must be provided and is achieved by the reservoir and piston assembly indicated generally by the numeral 42 which is connected to the end of the conduit 14.

The conduit 14 fluidly communicates at 44 with reservoir 46 in which is mounted a piston 48. The piston 48 is connected to conventional means (not shown) adapted to move the piston in the vertically upwardly direction as viewed in FIG. 4 to create a low pressure area in the reservoir 46 to in effect suck the fluid contained in conduit 14 into the reservoir. When the visual display has been moved completely through the conduit 14, the fluid collected in reservoir 46 is exhausted through a valve 50 which covers an exhaust opening 52 in the bottom of reservoir 46. To create a static display, piston 48 is maintained stationary and valve 50 is closed to flow to preclude movement of the fluids in conduit 14. When exhausting the fluid contained in reservoir 46, valve 50 is opened and piston 48 is moved downwardly to exhaust reservoir 46. To prevent fluid still contained in conduit 14 from being forced back up into reservoir 12, a valve 54 is provided which is adapted to close the tube 14 to back flow of fluid contained in conduit 14.

The means for providing a static display described in connection with FIG. 4 may also be adapted for use with the tube of FIG. 3 by simply removing or isolating fluid separator 20 and recirculation mechanism 22 and providing a conventional plug in the bottom of the conduit to halt movement of the visual display after it has been formed and properly located in the conduit.

Figure 5:
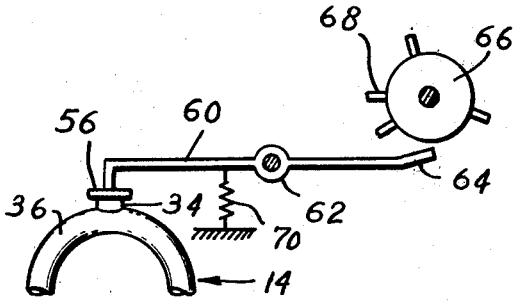
FIG. 5 is a detail view of an apparatus for intermittently injecting the second fluid into the first fluid.

Referring now to FIG. 5, there is depicted an apparatus for controlling the injection of gas into the conduit 14 adapted to cooperate with orifice 34. This apparatus consists of the valve 56 shown in FIG. 4 which is adapted to normally close orifice 34. Value 56 is in turn connected to an arm 60 mounted on a pivot post 62. Arm 60 has a finger 64 extending therefrom and positioned adjacent to a valve actuator 66 which is provided with a plurality of projections 68 adapted to contact finger 64 to rotate arm 60 about pivot 62 to open orifice 34 to flow of gas. As can be seen in FIG. 5, the projections 68 are spaced in accordance with the particular frequency and length of orifice opening desired to automatically control the timing and duration of gas injection into the conduit 14. Although shown as rather thin projections, the projections 68 may be made arcuately thicker than shown to provide for a rather extended period of valve opening without the necessity of providing more than one projection to hold the valve open for an excessive length of time. To keep the conduit 14 closed to atmospheric pressure at the orifice 34 when the gas is not being injected, a conventional spring 70 is provided offset from pivot post 62 to normally press the valve 56 against orifice 34.

Figure 6:
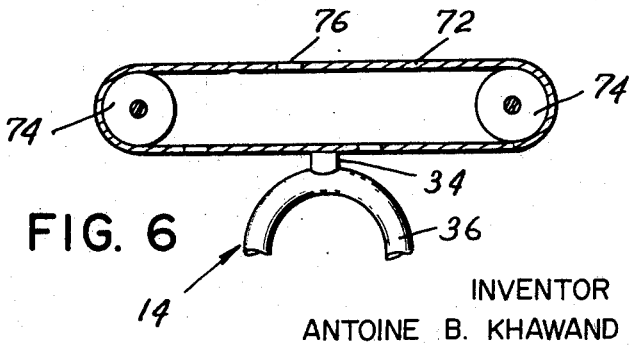
FIG. 6 is a detail view of still another embodiment of an apparatus for intermittently injecting the second fluid into the first fluid carried in the tube.

Referring now to FIG. 6, there is depicted a second embodiment for controlling the injection of gas into the conduit 14 which is comprised of an endless belt or band 72 mounted for rotation by conventional means on rollers 74. The band is provided with a plurality of valve openings 76 therein corresponding to a valve open position for permitting gas to be injected into the conduit 14. The size of the valve openings 76 and their spacing are governed by the desired display pattern and speed at which the band is driven. If the band is driven at a very slow speed, the valve openings 76 need not be large to permit a large volume of gas flowing into the conduit 14, whereas if the speed of the band is rather high, the size of the valve openings 76 must be increased to permit the same volume of gas to be injected into the conduit 14. Of course, the size of the valve openings 76 may be rendered unimportant if the gas injection mechanism used is a high pressure mechanism adapted to supply large volumes of gas in relatively short periods of time. If such is the case, then the rotating band will be used only to determine the spacing between subsequent injections of gas into the conduit 14.

Although not shown in any of the above described embodiments, any conventional gas injection mechanism such as a simple valve, rotary pressure pump, recirculating ball valve or the like, may be used in conjunction with the orifice 34 to inject gas into the conduit 14. It is also understood that such a conventional device may be used by itself in place of the control methods of FIGS. 5 and 6 for controlling the amount and timing of gas injection.

Referring now to FIG. 7, apparatus for separating and conjointly recirculating a fluid in a closed loop system is shown in which the gas separator 20 is simply a reservoir in fluid communication with the end of the conduit 14. In the case where the two fluids used are a liquid and a gas, 38 and 32 respectively, the lighter gas 32 will collect at the uppper end of the reservoir 78 while the heavier liquid 38 collects at the bottom thereof. When a gas such as air and a liquid are used to produce the visual display, it is usually desirable to recirculate the liquid but not the air. Accordingly, a relief valve 80 is provided in the upper portion of reservoir 78 which is adapted to be periodically opened either by hand or automatically to exhaust excess air contained in the reservoir 78 to atmosphere.

To achieve recirculation of the liquid contained in reservoir 78, a conduit 82 is mounted in fluid communication with the reservoir 78, and the device 22 for removing the liquid from the reservoir for recirculation. The device for removing the liquid from reservoir 78 consists of a plate 84 having a plurality of orifices 86, 88 and 90 therein adapted to selectively communicate with cylinders 92 and 94. Cylinders 92 and 94, formed in movable block 95, are each provided with a movable piston 96 and 98 respectively for controlling the removal fluid from the fluid separator 20.

In the position of movable block 95 shown in FIG. 7, cylinder 94 and its associated piston are in fluid communication through conduit 82 with fluid separator 20 and cylinder 92 is in fluid communication with conduit 100. Conduit 100 fluidly connects to a conduit 102 which in turn fluidly communicates with pump 26 for recirculating the fluid. In addition, conduit 102 connects with another conduit 104 which in turn communicates with orifice 90 in plate 84 for reasons to be described hereinbelow.

In operation, a continuous suction is applied by the pump 26 to conduits 100, 102 and 104. In the position of the movable block 95 shown in FIG. 7, a suction force is exerted by pump 26 for the removal of liquid contained in cylinder 92. This suction force causes piston 96 to move upwardly in cylinder 92. Behind cylinder 92 and in a closed loop 106 connecting cylinder 92 to cylinder 94 is a hydraulic fluid for assuring concurrent movement of the pistons 96 and 98. As the piston 96 begins to move upwardly, the combined pressure of the fluid in conduit 82 on piston 98 and the slight vacuum pressure created in closed loop 106 urge piston 98 downwardly to permit cylinder 94 to fill up with liquid 38 while concurrently urging the liquid contained in cylinder 92 into pump 26 for recirculation. As piston 96 moves upwardly, movable block 95 is shunted to the right as viewed in FIG. 7 to bring cylinder 92 under conduit 82 and cylinder 94 under orifice 90 where the pistons reverse their direction of movement and piston 98 moves upwardly to eject liquid 38 to pump 26.

The diameters of cylinders 92 and 94 are equal to or greater than the distance between either conduit 100 or 104 and conduit 82 so that as movable block 95 is moved, the cylinders are in continuous contact with either conduit 100 or 104 to continuously remove fluid from fluid separator 20 and to continuously recirculate the removed fluid.

If desired, an intermittently moving visual display may be provided for by simply making the diameters of the cylinders less than the distance between conduit 100 or 104 and conduit 82. In such case, the visual display will be held in fixed position in the conduit 14 until contact between either conduit 100 or 104 and one of the cylinders is reestablished.

Although the visual display created by the apparatus of the present invention has been described as either a static display or a moving display, it will be appreciated that a vibrating visual display can also be provided for by simply creating a static display as described above and providing means for periodically shifting the display between predetermined positions in the tube. This may be accomplished by inserting a small piston at one end of the tube and periodically moving the piston to intermittently apply compression and suction forces to the fluid to cause the visual display to move in conjunction with the movement of the piston.

Where a static display is desired, the conduits of the instant invention may be installed empty and apparatus for charging the conduits with the plurality of fluids may be moved to the site of installation and the conduits charged at the site to create the visual display. Of course, all conduit openings would then be capped by conventional methods to maintain the static display.

Referring now to FIG. 8, the conduit for carrying the fluids is shown as a single multiply reentrant continuous conduit 108. The different fluids are injected in a predetermined manner as previously described in connection with FIGS. 1–7. However, only one conduit is utilized in this embodiment to form the desired display and the spacing of the fluids is geared to present the desired visual display in the one conduit 108. Of course, the use of a single conduit as shown is better adapted to the creation of a static display than a moving one but it is within the scope of the present invention to use a single conduit to form a moving visual display.

Although it is desired to utilize one or more selfcontained conduits in the present invention, it is not essential and other forms of fluid conduits such as those depicted in FIGS. 9 and 10 may also be used. More specifically, FIG. 9 details a plurality of conduits 110 which are the product of opposing grooved surfaces 112 placed in separate opposing layers 114. The opposing layers 114 are sandwiched together to create the conduits 110. In this manner, it is quite simple to manufacture the continuous tube or conduit 108 shown in FIG. 8 or a plurality of separate tubes.

FIG. 10 depicts conduits 110 made up of a sandwich arrangement comprising two layers 116 and 118, the layer 116 having a plurality of grooves therein to form the conduits 110.

Referring now to FIG. 11, a plurality of conduit or tube layers 120 are shown encased in a translucent or transparent material. These conduits may be formed in the manner described in connection with the embodiment of FIGS. 9 and 10 or they may simply be conventional tubes placed one in front of each other. The layers 120 are made of a translucent or transparent material to permit viewing of all of the layers 120 when viewed for instance in the direction of the arrow 124.

The system of conduits here shown contemplates the use of different colored fluids along with translucent or transparent fluids to create a three-dimensional visual pattern where the background fluids will be seen whenever a transparent section of fluid carried in the front conduits is in the line of vision. It is apparent that through the use of layered conduits, many different visual patterns may be created.

Referring now to FIG. 12, there is shown one method and apparatus for injecting different colored fluids 126 and 128 into a single conduit or tube 130. Each of the fluid reservoirs are provided with an orifice 132 adapted to communicate with the conduit 130. The conduit 130 is mounted on a movable plate 134 adapted to move the conduit 130 into register with orifices 132 in a predetermined pattern to create the desired visual pattern in the conduit. A conventional salenoid and spring assembly 136 may be used to move the plate 134 to intermittently register the orifice 132 with the conduit 130. Of course, the plate 134 is placed directly against the reservoirs 126, 128 to prevent leakage of fluid from the reservoirs along the plate.

If desired, the plate 134 may be kept stationary and the reservoirs moved or both may be moved conjointly to create the desired intermittent inlet of different fluids to the conduit 130.

In many instances, it may be preferred to utilize back lighting to permit visual observation of the pattern created in accordance with the present invention. In such case, the conduits or tubes and their carrying means must be made at least translucent. However, where front lighting is envisaged, an opaque backdrop may be used to provide the reflective qualities necessary to permit viewing of the pattern carried in the conduits or tubes.

In any of the conduits described herein, it is preferred that the interior of the conduit be non-wettable by the fluids used to help prevent relative movement between the different fluids used. Where it is desired to manufacture the conduit from glass or some other wettable material, the interior of the conduit may be coated with a non-wettable substance. The coating may be used to achieve visual effects for instance by embedding a phosphorescent material in the coating. In the case where the inner surface of the conduit is naturally not wettable by the fluids used, the phosphorescent coating may still be used as long as it is made non-wettable. It is well within the skill of the art to determine the type of material from which the conduit is to be made to provide non-wettability for given fluids. The same is true of non-wettable coatings.

The conduit of the instant invention, although shown and described as single straight or reenfrant conduits, may be made in an interwoven configuration as many separate conduits may be used. For example, the use of interwoven conduits can create many types of interesting displays by superposition of differently colored fluids. In addition, various information patterns can be created at different areas in the interwoven structure which may not be possible with non-interwoven conduit systems.

Insofar as the use of a plurality of separate conduits is concerned, the separate conduits may all be fed from one or a plurality of different reservoirs. The feeding of fluids may be controlled as a unit or individually for each conduit to yield many different visual artistic or information patterns as desired.

Additionally, the conduits used in any of the embodiments of the instant invention may be made with varied or variable cross-sections along the length of a single conduit. It will be appreciated that cross section variation changes the fluid flow parameters such as velocity and linear length, thereby permitting the creation of still more artistic and informational visual displays. An example of an informational display is the use of conduits having varying cross sections for use in a clock.

When using the varied cross sectional conduits for clocks or timing functions generally, the conduit cross sections must vary in accordance with known physical laws. For example, where a constant pressure is used to move the fluid through the conduits, and the length of each section of conduit is the same, then the conduit section used for hour indication must have its cross section increase be approximately the square root of twelve. This is depicted in FIG. 13 wherein numeral 138 denotes the smaller cross section conduit and numeral 140 denotes the larger cross section conduit used for hour measurement. Numeral 142 denotes a constant pressure source to which both conduits are connected. Of course, a recirculation loop is used to recycle the fluids as described previously. In this manner, the use of different fluids in one or more conduits can be used for time measurement, of course, by varying conduit lengths and operating pressures, the cross sectional changes needed will be varied accordingly.

A single conduit of either constant or variable cross section may be used to measure time if desired. In such case, a constant diameter helical conduit 144 may be used as shown in FIG. 14. Only two differently colored fluids 146 and 148 are shown although more than two may be used if desired.

As shown in FIG. 14, the cross section of conduit 144 is constant. With constant cross section and pressure, circular or arc travel speed is greater than the vertical travel speed of the meniscus (fluid interface) 150. Therefore, the hour and minute timing function can be achieved by correlating arc travel to vertical travel of the meniscus. Obviously, the relationsip between vertical and arc travel of the meniscus need not be in the ratio of twelve to one as long as measuring indicia are appropriately spaced in both arc and vertical directions. If desired, the arcs may be helices 152 of very small lead angle as shown in FIG. 15, the complete traverse of which takes approximately one hour. Small vertical sections 154 between helices are provided for quick transmission of the meniscus to the next upper helix. In this manner, each helix 152 corresponds to a particular hour number, thus simplifying the visual observation of the hour.

The time keeping conduits shown in FIGS. 14 and 15 may be circular as described or planar. In either case, the minute readout may be achieved by providing numerals from zero to sixty either inside or outside the conduit which are progressively covered by the advancing meniscus. Since the conduit is helix, this presents no particular problem. If desired, the entire system can be rotated to keep the meniscus close to the person viewing it.

The instant invention is adaptable for use in many non-related arts such as the measurement of physical parameters, clothing and household accessories, games etc. For example, fluids are responsive to changes in pressure and temperature. Therefore, the use of immiscible differently colored fluids can be used as a direct pressure or differential pressure measuring device or as a heat measuring device.

As a direct pressure measuring device, the fluids carried in the conduits are subjected to the pressure to be monitored. Fluctuations in the monitored pressure are directly and immediately evidenced by meniscus movement. A chart on which indicia are placed may be used to directly read the monitored pressure.

As a differential pressure measuring device, the fluids may be subjected to pressure at both ends of the conduit to cause the meniscus to move opposite to the greater pressure force. In addition, layered conduits or parallel conduits may be used to measure differential pressure. In the first instance, the enhancement or suppression of color by superposition or de-superposition respectively, may be used to indicate that an undesirable differential exists. In the second instance, alignment or misalignment of meniscusses separately carried in the parallel conduits may be used to indicate the existence of pressure differentials. Since heat causes pressure increases or decreases, the above described system for pressure and differential pressure measurement may be adapted for thermal monitoring or measurement.

The instant invention may be adapted for use in clothing accessories. For example, a belt can be made of one or more conduits running either horizontally or vertically, each conduit carrying a plurality of different fluids to create a desired visual display pattern. The pattern may even be made moveable in response to the wearers breathing by encasing the ends of the conduits in the region of the buckle space in a compressible bulb. Normal breathing of the wearer will then cause movement of the various fluids in the conduits to create a constantly varying and interesting visual display.

Insofar as household accessories are concerned, the conduits of the instant invention may be used to make lamp shades or window shades. By using one or more conduits either wound or placed in parallel or interwoven configuration, many different visual patterns may be provided which will be accentuated by the light which filters through the shade. By providing layered conduits or parallel conduits in a recirculatory loop the shade may be made to act as a rheostat to control room lighting by providing for movement of colored and transparent fluids into and out of positions in which more or less light is blocked off. This can also be achieved by superposition of the same or differently colored fluids when layered conduits are used in order to create more or less opacity in the shade.

Other interesting types of visual displays may be created simply by varying the form of the conduit. More specifically, FIG. 16 depicts a helical conduit square configuration 156. Only three layers are shown but it is understood that as many layers as desired may be used. In this configuration, the visual display may be created as a visual mating of a portion of a visual pattern carried on rear surface 158 (not shown) and a portion of a visual pattern carried on the front surface 160. The total visual display is created by juxtaposition of these two viewing portions. In this manner, visual displays which are three dimensional may be created. A planar view in section of just such a visual pattern is shown in FIG. 17 where the numerals 158 and 160 refer respectively to the image portions formed on the back and front portions of the conduit 156. It will be evident that the visual display can be readily readily changed by moving the front and back image portions into and out of register. Of course, additional images may be provided which are carried along side sections 162 of the conduit so that as the front and back portions are moved, the side sections will then register to form an image. In addition, various layers may hold different image portions such that when the fluids are moved in the conduits, image portions in different layers will continuously register with image portions in other layers to form constantly changing multiple displays.

The square configuration shown in FIG. 16 may be changed to round, elliptical or any other geometric shape to suit the user. In addition, the spatial configuration shown in FIG. 16 may be made planar and it could still retain the creative and varied visual display capability described above.

The conduit shown in FIG. 18 is a helically reentrant conduit 164 adapted to form a visual display, however, this shape is particularly suited to forming appearing and disappearing displays as the fluids are moved along the arcs defined by the conduit. As shown, colored liquid segments 166 will move in one direction when viewed and colored liquid segments 168 will appear to move in the other direction when pressure is applied to either the in or out conduit sections. If the right hand segment 168 and the left hand segment 166 (as viewed in FIG. 18) only were to be retained, the movement described above would make these segments appear to separate.

It shoud be quite evident at this point that there are endless uses to which the invention can be put, as well as endless varieties of displays.

In all of the above embodiments, the conduits were described as either rounded at corners or as having sharp corners. Although sharp corners may be used if desired, for best results the corners should be rounded sufficiently to prevent meniscus destruction. The term meniscus destruction refers to the tendency of even immiscible fluids to lose their sharp line separation due to turbulence effects which can occur at sharp boundaries. The conduit may be provided with a turning radius at least equal to the diameter or largest cross sectional dimension of the conduit to tend to lessen the degree of turbulence at the corner.

The conduits of the instant invention may have the various fluids injected therein in an automatic operation of the type previously described. However, this function may be controlled by modern means such as punched cards, punched tapes, magnetic tapes etc., as are well known in the art. Use of such methods makes the corrections usually necessary in the injection process to obtain proper image registry much easier.

More specifically, the manufacture of conduits presupposes a certain degree of tolerance in its internal dimensions. These tolerances tend to be additive and are manifested as a net linear size error of the fluid segment at the portion of the conduit designed for carrying the visual display. The term linear error as here used simply means that the particular fluid segment has had its length changed in either the plus or minus direction. Error of this type may be corrected for using, as for example, the apparatus schematically shown in FIG. 19. As shown, 170 is a fluid reservoir for injection of one fluid and 172 denotes an injection apparatus for injection of a second fluid. The injection apparatus may take any of the forms previously described.

The second fluid is denoted by the numeral 174 and is shown having a given length $x$ just subsequent to injection. The same fluid segment is shown in the viewing area denoted by numeral 176 and its length has increased to $y$ due to tolerance buildup in the inner dimensions of the conduit. To correct for the tolerance buildup, a withdrawal unit 178 is fluidly connected to an end of the conduit. The withdrawal unit is adapted to withdraw a predetermined weight or volume of fluid, such as one gram, and the movement of the second fluid segment 174 is measured either visually or by conventional optical scanning devices which may or may not be coupled with photosensitive film (not shown). It is simple to calculate the movement of second fluid segment 174 assuming a perfect conduit having no tolerance buildup when a given weight or volume of fluid is withdrawn. Deviations from this norm accuratel reflects the overall tolerance buildup and correction is then made at the injection apparatus 172 to either increase or decrease volume of the second fluid segment admitted to the conduit. The measured movement per unit volume or weight withdrawn directly relates to length of the second fluid segment since less movement than ideal signifies a decrease in length and more movement than ideal signifies an increase in length. In this manner, fluid segment length correction can be achieved for each visual display apparatus.

Where punch cards or tapes or other automatic devices are used to control fluid injection, the corrections may be made directly on the tapes or cards or new tapes or cards embodying the corrections can be supplied.

Another factor which may tend to disrupt accurate alignment of fluid segments to form a visual display is slippage. Slippage as here used relates to the tendency of fluids having high viscosity and surface tension to cling to the inner surface of the conduit and to be displaced in other fluids having less viscosity and lower surface tension. Such slippage results in a net "position error" and is correctable by pre-calculating the effect from the known physical properties of the fluids used and the inner surface of the conduit in conventional manner or by measuring the position error and correcting for it at the fluid injection stage. This may be done by delaying or speeding up the injection of the various fluids to achieve the desired position relationship in the conduit viewing area. In addition, it has been found that by placing in circumferential grooves in the interior surface of the conduit, the film which tends to form on the interior surface is broken, thereby lessening any tendency for slippage to occur.

Still another factor which may tend to generate errors is thermal expansion. In cases where this may be objectionable, the whole apparatus may be encased in a translucent or transparent fluid medium which tends to even out thermal differences or fluids may be used which exhibit little thermal expansion. Another method for achieving thermal linear correction is to provide individual compressible and expandable coatings or areas in the conduit or by providing complete compressible and expandable conduits or inner coatings to compensate for thermally caused volume deviations.

In the use of the conduits of the present invention for time keeping functions, it will be understood that a plurality of conduits having a plurality of meniscuses therein may be used. In one such arrangement, it is contemplated that one or more conduits which initially contain a single fluid may be used where the fluid is moved to uncover the time indicia to thereby indicate the proper time. This particular structure may be used to provide pressure, temperature or other informational indications as described above.

Where wettable conduits are used, it is possible to inject gas bubbles into the fluid which then will move due to gravitational forces in the fluids to create still further different and interesting displays. Of course, the bubbles may be injected in predetermined fashion to form a given visual display which is moved by the gravitational forces.

Many modifications of the above described apparatus will occur to those skilled in the art and it is intended to cover all such modifications which are within the spirit and scope of the invention as defined in the appended claims.

What is claimed is:

1. Apparatus for creating a visual display having a discrete and predetermined pattern of information comprising a plurality of liquid conduit segments which are arrayed in a matrix with said segments side by side adjacent one another, respective sources of first and second substantially non-compressible liquids which are immiscible with each other and of varying color to thereby form said pattern and backgound for said pattern, respectively, means for introducing said second background forming liquid into said segments, and means for introducing discrete quantities of said first pattern forming liquid into said segments at predetermined positions with respect to the second liquid to fill the segments at said positions to form for viewing the predetermined pattern by the said discrete quantities of said first liquid appearing said adjacent segments of the matrix, and means for introducing an additional amount of one of said liquids into said matrix of segments to move the predetermined pattern formed by the quantities of first liquid as a unit through the matrix.

2. The visual display apparatus of claim 1 further comprising means for recirculating at least said first liquid.

3. The visual display apparatus of claim 1 wherein the said conduit segments have a non-wettable inner surface.

4. The visual display apparatus of claim 1 wherein said conduit segments comprise a single multiply reentrant continuous conduit.

5. The apparatus according to claim 1 further comprising means for minimizing the destruction of the meniscus between adjacent immiscible liquids as said liquids are moved along their flow paths.

6. The apparatus according to claim 5 wherein said means for minimizing meniscus destruction comprises circumferential grooves on the interior of said conduit segments.

7. The visual display apparatus of claim 1 wherein at least one conduit segment has regions of varying cross section.

8. The visual display apparatus of claim 1 further comprising a liquid withdrawal unit adapted to withdraw a predetermined amount of liquid in the visual area of said conduit segments to determine whether there is tolerance buildup in said conduit segments due to variations in the internal dimensions of said conduits.

9. The visual display apparatus of claim 1 further comprising a liquid bath in which said conduit segments are immersed to minimize thermal effects.

10. The method of creating a visual display having a discrete and predetermined pattern of information comprising the steps of providing a plurality of fluid conduit segments, arraying said segments in a matrix with said segments side by side adjacent one another, providing respective sources of first and second substantially non-compressible liquids which are immiscible with each other, and of varying color to thereby form said pattern and background for said pattern, respectively, introducing said second background liquid into said segments, introducing discrete quantities of said first pattern liquid into said segments at predetermined positions with respect to the first liquid to fill the segments at said positions to form for viewing the predetermined pattern by the said discrete quantities of said first liquid appearing in said adjacent segments of the matrix, and introducing an additional amount of one of said liquids into said matrix of segments to move the predetermined pattern formed by the quantities of first liquid as a unit through the matrix.

11. The method specified in claim 10 further comprising the step of continuously moving said first and said second liquids in said conduit segments to create a moving visual pattern.

12. The method according to claim 10 further comprising the step of creating a new pattern by changing the relative position of the quantities of the second liquid without altering the regular flow path of said first liquid.

13. The method according to claim 12 further comprising the step of forming the interior surface of said conduit segments to minimize the destruction of the meniscus between said first and second liquids.

14. The method according to claim 13 wherein the step of forming the interior surface of said conduit comprises circumferentially grooving the interior surface of said conduit.

* * * * *